United States Patent [19]

Ohtani et al.

[11] 4,066,115

[45] Jan. 3, 1978

[54] METHOD FOR PRODUCING HEAT PIPE UNITS

[75] Inventors: Iwao Ohtani, Tokyo; Hashime Takahashi, Yokohama, both of Japan

[73] Assignee: Tokico Ltd., Japan

[21] Appl. No.: 737,668

[22] Filed: Nov. 1, 1976

[30] Foreign Application Priority Data

Oct. 31, 1975 Japan ..... 50-131915

[51] Int. Cl.[2] ..... B22D 19/00; B22C 9/02

[52] U.S. Cl. ..... 164/9; 164/47; 164/333; 164/349; 264/337

[58] Field of Search ..... 164/9, 11, 47, 107, 164/340, 53, 111, 332, 333, 92, 105, 231, 349, 351, 91, 98, 397, 112; 249/85, 84, 91, 92; 425/121, 123, 125, 110, DIG. 38, DIG. 57; 264/259, 261, 298, 221, 313, 317; 269/7; 29/157.3 R, 157.3 C, 423, 424

[56] References Cited

U.S. PATENT DOCUMENTS

| | | | |
|---|---|---|---|
| 2,720,799 | 10/1955 | Pfost | 164/111 |
| 3,064,345 | 11/1962 | Herman et al. | 264/298 X |
| 3,439,087 | 4/1969 | Ledeen | 264/221 X |

*Primary Examiner*—Francis S. Husar
*Assistant Examiner*—John S. Brown

[57] ABSTRACT

There is disclosed a method for molding a plate-like cross-structure on a heat pipe or a bundle of heat pipes to serve as a support plate or a baffle. The plate-like cross-structure is formed integrally on the heat pipe within a molding box, in an extremely simplified manner irrespective of the shape of the pipe.

17 Claims, 7 Drawing Figures

METHOD FOR PRODUCING HEAT PIPE UNITS

BACKGROUND OF THE INVENTION

This invention relates to a method for producing heat pipe units for heat exchangers and the like.

Heat exchangers usually have a bundle of heat pipes each containing a working fluid which, in case of an air conditioner, exchanges heat with intake and exhaust air through generation of latent heat of evaporation and condensation according to the principles well known in the art. Such heat pipes are normally carried in support plates or a baffle plate which divides the pipes into two separate sections respectively in contact with the two fluids between which the heat is to be transferred. When the heat pipes are straight in shape and without fins, it is relatively easy to mount a plate thereon to serve as a support plate or a cross baffle. However, the mounting of the plate or plates becomes very difficult and sometimes almost impossible with heat pipes carrying fins on their circumferences or with heat pipes of more complicate shapes, for example, heat pipes of helical, spiral, serpentine or meandering shapes.

It is an object of the present invention to provide a method for producing without difficulty heat pipe units having a heat pipe or a bundle of heat pipes carried in a plate-like cross-structure, to serve as a support plate, mounting plate or baffle.

It is a more particular object of the present invention to provide a method for molding a plate-like cross-structure on a heat pipe or a bundle of heat pipes within a molding box in a facilitated manner irrespective of the shape of heat pipe or pipes.

SUMMARY OF THE INVENTION

According to the present invention, there is provided a method for producing a heat pipe unit having a heat pipe or a bundle of heat pipes carried in a plate-like cross-structure, the method comprising placing a heat pipe in a molding box; holding the heat pipe in an upright position in the molding box; feeding sand into the molding box to bury the heat pipe up to a level where the plate-like cross-structure is to be provided, while vibrating the molding box to compact the sand in the box; pouring a molding material on the levelled surface of said sand in a predetermined thickness; solidifying the molding material to form a plate-like cross-structure on the heat pipe integrally therewith; discharging the sand out of the molding box; and taking the thus-formed heat pipe unit out of the molding box.

In one particular form of the invention, a facing material is applied on the levelled surface of the sand in order to give a better surface finish to the cross-structure to be molded.

The above and other objects, features and advantages of the invention will become clear from the following description and the appended claims, taken in conjunction with the accompanying drawings.

DESCRIPTION OF THE PREFERRED EMBODIMENTS

Figure 1:
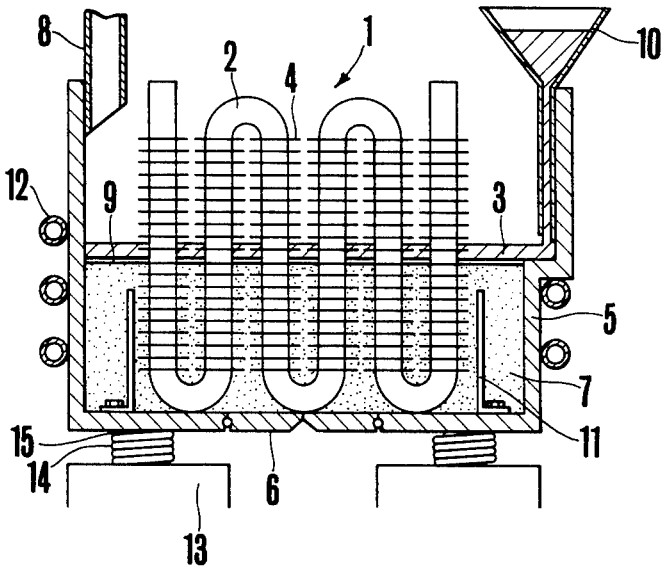
FIG. 1 is a diagrammatic view illustrating the method of producing a heat pipe unit according to the present invention.

Referring to the accompanying drawings and first to FIG. 1, there is shown by way of example a heat pipe unit 1 using a heat pipe 2 of a surpentine or meandering shape. The heat pipe 2 has sealed therein a working fluid for heat transfer through generation of latent heat of vaporization and condensation of the working fluid. The heat pipe 2 is provided with a number of fins 4 on and in engagement with its circumference at suitable intervals along the length thereof, and is provided a plate-like cross-structure 3 which, in this case, serves as a baffle plate dividing the heat pipe 2 into two sections at a median point between the evaporation and condensation ends of the respective parallel pipe portions.

According to the present invention, the baffle plate 3 can be formed in a very facilitated manner, even on a heat pipe of a serpentine shape as in FIG. 1. In the first place, the serpentine pipe 2 with fins 4 is put in a molding box 5, which is open at the top end and provided at the bottom with a doorway 6 which is normally closed. The heat pipe 2 is held in an upright position as shown in FIG. 1 by pre-charged sand or upright support members 11 fixed on the bottom of the molding box 5. After positioning the heat pipe 2 in the molding box 5, sand is poured thereinto through a hopper 8 which is provided at one end of the molding box 5, until the sand reaches a level where the baffle plate 3 is to be formed. The sand 7 may be natural or synthetic sand or other suitable granular material. While filling sand 7 in the molding box 5 up to a baffle mounting level, a vibrator plate 13 is actuated, and its vibrations are transmitted to the molding box 5 through a support rod 15 to level the surface of the sand 7 in the molding box. Shown at 14 is a spring which serves to transmit the vibrations of the plate 13 smoothly to the molding box 5. As a result, the sand 7 is uniformly compacted in its entirety and its surface is suitably levelled. The feed of sand to the molding box 5 is stopped as soon as the sand 7 reaches the baffle mounting level of the heat pipe 2, and a facing material 9 is coated on the levelled surface of the sand 7 by spraying or other suitable means to form a smooth surface layer. Thereafter, a liquid synthetic resin or molten metal of low melting point is poured on the coated surface of the sand 7 through a funnel 10 until a desired thickness is attained. Upon hardening or solidification, the poured synthetic resin or metal forms a solid plate-like cross-structure on the heat pipe at a point intermediate between the evaporation and condensation ends thereof.

When a synthetic resin is used for the baffle plate 3, it is preferred to employ a thermosetting resin rather than a thermoplastic resin. For example, a blend of epoxy resin and fine metal powder such as Debcon (a trade name for a product of Flexane) will be suitable. Examples of metals having low melting points include Pb-Sn alloys or Fe alloys. Where the heat pipe 2 is of a copper- or iron-based alloy, aluminum may be used as a molding material.

Furthermore, the kind of facing material 9 which is applied to the surface of the sand to fill the interstices between the sand grains is selected in relation to the kind of the material for the baffle plate 3, e.g., lacquer is satisfactory for a baffle of synthetic resin. A solution of graphite in alcohol can serve as a facing material when a metal is used for the cross-structure. When molten metal is used for molding the plate-like structure, it is preferred to feed cooling water through water pipes 12 which are mounted around the side walls of the molding box 5 to enhance solidification of the molten metal. On the other hand, when a synthetic resin is used for the baffle plate 3, it is preferred to effect the hardening of the resin material by a method which suits the nature of the particular resin material employed. For instance, with a thermosetting resin material, one or more heaters (not shown) may be embedded at suitable positions in the molding box 5 or, alternatively, heat radiation or hot air may be applied to the resin layer from above.

As soon as the molten metal or liquid synthetic resin for the baffle plate 3 is solidified sufficiently, the doorway 6 is opened to discharge the sand 7 completely out of the molding box 5, and the heat pipe unit 1 having the baffle plate 3 integrally molded on the heat pipe 2 is taken out of the molding box 5. The heat pipe unit 1 thus obtained is ready for mounting in a heat exchanger casing after removing sand which may remain on the surface of the heat pipe 2 and machining the baffle plate 3 into a suitable shape.

The heat pipe unit according to the present invention is adaptable to diversified types of heat exchangers in addition to the particular examples shown in the drawings and susceptible to various variations and modifications. For example, the heat pipe itself may not be of the serpentine shape and the molded plate structure may not necessarily be used as a baffle plate.

Figure 2:
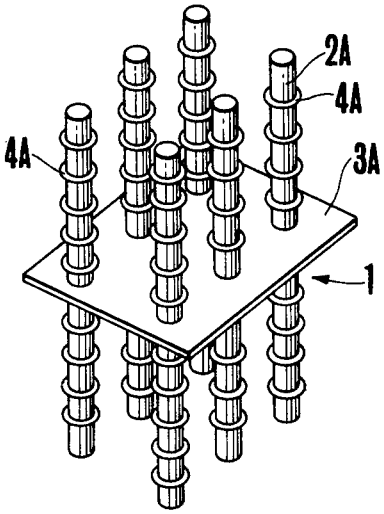
FIGS. 2 through 5 are diagrammatic perspective views of heat pipe units having heat pipes of diversified shapes.

FIGS. 2 through 5 illustrate a number of variations in the form of the heat pipe. FIG. 2 shows a heat pipe unit 1 with a bundle of straight pipes 2A each having fin tubes 4A provided on its circumference at suitable intervals along the length thereof. The straight heat pipes 2A are carried in a molded plate-like structure 3A in two rows and parallel to each other.

Figure 3:
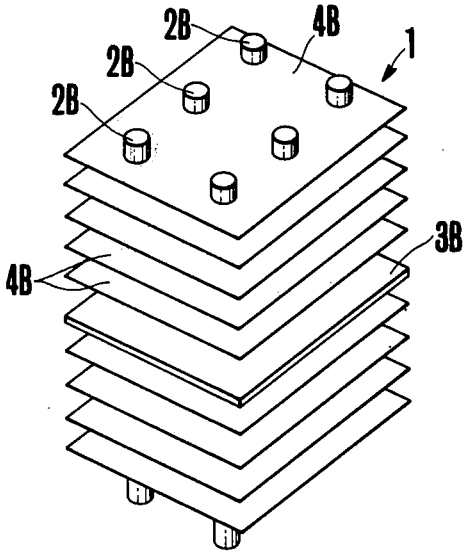

In FIG. 3, there is shown a heat pipe unit 1 with a bundle of straight heat pipes 2B in engagement with sheetlike fins 4B which are arranged at suitable intervals along the lengths of the heat pipes 2B. The unit 1 has a plate-like cross-structure 3B molded at a position substantially intermediate the opposite ends of the heat pipe bundle.

Figure 4:
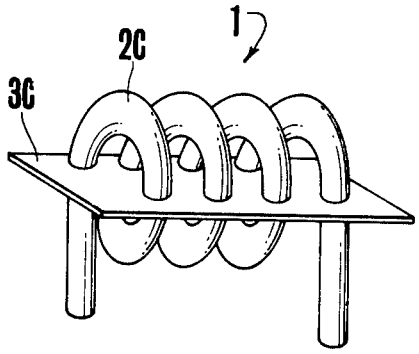
Figure 5:
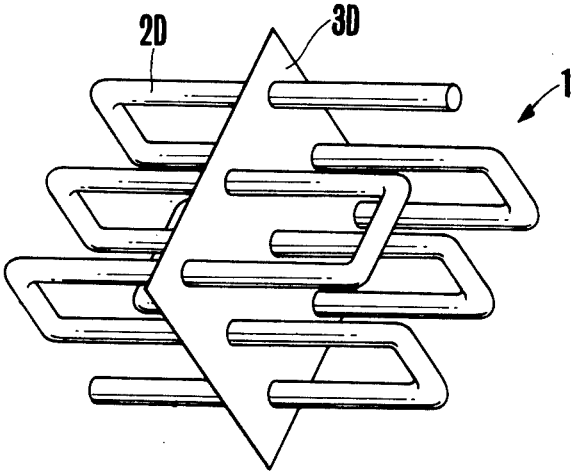

The heat pipe unit 1 of FIG. 4 has a helically turned heat pipe 2C carried similarly in a molded plate-like structure 3C. In FIG. 5, the heat pipe unit 1 is provided with a meandering pipe 2D which contains parallel and perpendicular turns at opposite ends to connect straight pipe portions which are arranged in three parallel rows. The heat pipe 2D is carried in a molded plate-like cross-structure 3D.

It will be understood from the foregoing description that the method of the present invention makes it possible to form a plate-like cross-structure on a heat pipe or a bundle of heat pipes in an extremely simplified manner irrespective of the shape of the pipe or pipes.

Figure 6:
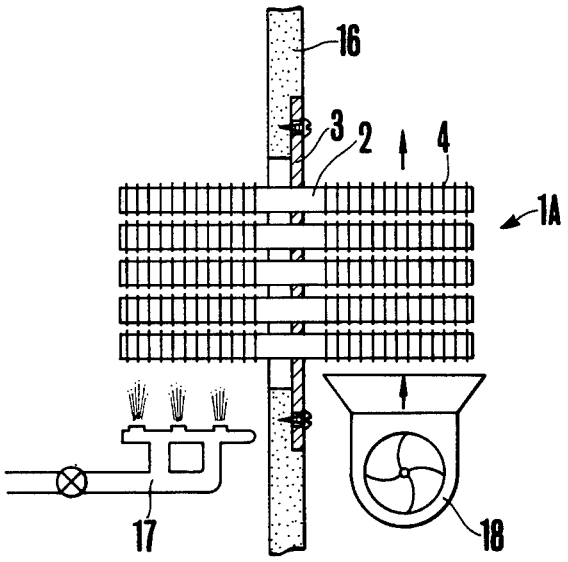
FIGS. 6 and 7 are diagrammatic sectional views illustrating examples of application of the heat pipe units according to the instant invention.
Figure 7:
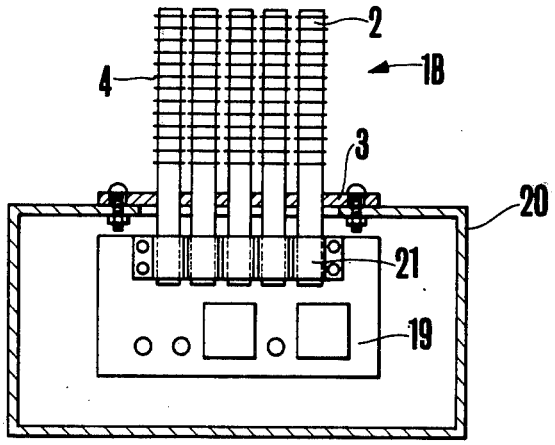

FIGS. 6 and 7 show examples of application of the heat pipe units fabricated according to the method of the present invention. FIG. 6 diagrammatically illustrates a heat pipe unit 1A as applied to a fan heater, wherein the unit has a bundle of straight heat pipes 2 with fins 4 and carried in two rows in a molded plate-like cross-stucture 3. The unit 1A is mounted in an opening in an enclosure wall 16 and fixed thereon by the plate-like structure 3 so that the opposite ends of the heat pipes 2 extend to the inner and outer sides of the enclosure wall 16. A burner 17 is provided on the outer side of the enclosure 16 to heat the outwardly extending pipe portions, while a fan 18 is provided on the inner side to send air through the inwardly extending heat pipe portions. In this example, the plate-like structure plays the double roles of a baffle plate and a mounting plate.

FIG. 7 shows a heat pipe unit 1B as applied to an explosion-proof type electronic applicance, wherein the unit similarly has a bundle of straight heat pipes 2 which, however, have fins 4 only on those pipe portions which are disposed on the outer side of a molded plate-like cross-structure 3. The unit 1B is mounted in an opening in an explosion-proof casing 20 of an electronic device 19 and fixed thereon by way of the plate-like structure 3. The inner bald ends of the heat pipes 2 are mounted in contact with the electronic device 19 to dissipate the heat which is generated in the device 19.

In the foregoing embodiments, the heat pipe 2 has been described as having a working fluid sealed therein. However, where the working fluid is of a low boiling point, the plate-like structure may be molded on an open empty pipe which has not yet been filled with the working fluid as otherwise the pipe may be broken due to an abrupt increase of internal pressure which will be caused by direct contact with the hot molten metal or heated thermosetting synthetic resin material during the molding operation. In such case, it is recommended that the cross-structure be molded on the heat pipes before sealing the working fluid therein.

The term "heat pipe" as used herein includes all the heat pipes with or without a capillary wick on the inner wall surfaces thereof.

We claim:

1. A method for producing a heat pipe unit having at least one heat pipe carried in a plate-like cross-structure, comprising:
   - placing a heat pipe in a molding box;
   - holding said heat pipe in an upright position in said molding box;
   - feeding sand into said molding box to bury said heat pipe up to a level where said plate-like cross-structure is to be provided, while vibrating said molding box to compact the sand and level the surface thereof;
   - pouring a molding material on the levelled surface of said sand to a predetermined thickness;
   - solidifying said molding material to form a platelike cross-structure on said heat pipe integrally therewith;
   - discharging said sand out of said molding box; and
   - removing the thus-formed heat pipe unit from said molding box.

2. The method as defined in claim 1, wherein said sand is selected from the group consisting of natural and synthetic sands.

3. The method as defined in claim 1, wherein said molding box is open at the top and provided with a normally closed doorway at the bottom thereof.

4. The method as defined in claim 1, wherein said molding box is vibrated by a vibrating plate through a spring.

5. The method as defined in claim 1, wherein said molding material is selected from synthetic resin materials and metals of low melting point.

6. The method as defined in claim 5, wherein said synthetic resin material is a thermosetting resin.

7. The method as defined in claim 6, wherein said molding material is solidified by a heater embedded in said molding box.

8. The method as defined in claim 6, wherein said molding material is solidified by heat radiated from above said molding box.

9. The method as defined in claim 6, wherein said molding material is solidified by hot air applied thereon from above said molding box.

10. The method as defined in claim 5, wherein said metal is selected from the group consisting of Pb-Sn and Fe alloys.

11. The method as defined in claim 10, wherein said molding material is solidified by passing cooling water through water pipes provided around the side walls of said molding box.

12. The method as defined in claim 1, further comprising the step of applying a facing material on the levelled surface of said sand before pouring said molding material.

13. The method as defined in claim 11, wherein said molding material is selected from synthetic resin materials and metals of low melting point.

14. The method as defined in claim 13, wherein said synthetic resin material is a thermosetting resin.

15. The method as defined in claim 14, wherein said facing material is lacquer.

16. The method as defined in claim 13, wherein said metal is selected from the group consisting of Pb-Sn and Fe alloys.

17. The method as defined in claim 16, wherein said facing material is a solution of graphite in alcohol.

* * * * *

UNITED STATES PATENT AND TRADEMARK OFFICE

CERTIFICATE OF CORRECTION

PATENT NO. : 4,066,115

DATED : January 3, 1978

INVENTOR(S) : Iwao Ohtani and Hashime Takahashi

It is certified that error appears in the above-identified patent and that said Letters Patent are hereby corrected as shown below:

Column 2, line 14, after "provided" insert -- with --.

Column 6, line 5, delete the numeral "11" and insert -- 12--

Signed and Sealed this

Twenty-fifth Day of April 1978

[SEAL]

Attest:

RUTH C. MASON
Attesting Officer

LUTRELLE F. PARKER
Acting Commissioner of Patents and Trademarks